US008205689B2

(12) United States Patent
Radford

(10) Patent No.: US 8,205,689 B2
(45) Date of Patent: Jun. 26, 2012

(54) STABILIZER AND REAMER SYSTEM HAVING EXTENSIBLE BLADES AND BEARING PADS AND METHOD OF USING SAME

(75) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/433,939

(22) Filed: May 1, 2009

(65) Prior Publication Data

US 2009/0294178 A1 Dec. 3, 2009

Related U.S. Application Data

(60) Provisional application No. 61/049,617, filed on May 1, 2008.

(51) Int. Cl.
*E21B 10/32* (2006.01)

(52) U.S. Cl. ..... 175/270; 175/268

(58) Field of Classification Search ..... 175/57, 175/265, 267, 268, 270; 166/332.3
See application file for complete search history.

(56) References Cited

U.S. PATENT DOCUMENTS

| | | | |
|---|---|---|---|
| 1,548,578 | A | 8/1925 | Blanchard |
| 1,678,075 | A | 7/1928 | Phipps |
| 1,772,710 | A | 8/1930 | Denney |
| 1,804,850 | A | 5/1931 | Triplett |
| 2,069,482 | A | 2/1937 | Seay |
| 2,177,721 | A | 10/1939 | Johnson et al. |
| 2,344,598 | A | 3/1944 | Church |
| 2,758,819 | A | 8/1956 | Kammerer, Jr. |
| 2,799,479 | A | 7/1957 | Krammerer |
| 2,882,019 | A | 4/1959 | Carr et al. |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |
| 3,220,481 | A | 11/1965 | Park |
| 3,224,507 | A | 12/1965 | Cordary et al. |
| 3,320,004 | A | 5/1967 | Garrett |
| 3,332,498 | A | 7/1967 | Page, Jr. |
| 3,433,313 | A | 3/1969 | Brown |

(Continued)

FOREIGN PATENT DOCUMENTS

| | | |
|---|---|---|
| EP | 0594420 | 4/1994 |

(Continued)

OTHER PUBLICATIONS

PCT International Search Report for International Application No. PCT/US2009/042511, mailed Dec. 1, 2009.

(Continued)

*Primary Examiner* — Giovanna Wright
*Assistant Examiner* — Kipp Wallace
(74) *Attorney, Agent, or Firm* — TraskBritt

(57) ABSTRACT

Drilling systems and methods for enlarging a borehole that include at least one expandable reamer and at least one expandable stabilizer axially spaced therefrom in a tubular string, such as a drill string, the at least one expandable reamer and the at least one expandable stabilizer being independently actuatable by different-sized actuation devices. A relatively lower tool is actuatable by a smaller actuation device, such as a drop ball, which passes through a relatively higher tool in the drill string without triggering the higher tool.

26 Claims, 4 Drawing Sheets

U.S. PATENT DOCUMENTS 3,753,471 A 8/1973 Kammerer, Jr. et al.
3,845,815 A 11/1974 Garwood
3,916,998 A 11/1975 Bass, Jr. et al.
4,055,226 A 10/1977 Weber
4,111,262 A 9/1978 Duncan
4,304,311 A 12/1981 Shinn
4,440,222 A 4/1984 Pullin
4,456,080 A 6/1984 Holbert
4,458,761 A 7/1984 Van Vreeswyk
4,540,941 A 9/1985 Walkow
4,565,252 A 1/1986 Campbell et al.
4,635,738 A 1/1987 Schillinger et al.
4,660,657 A 4/1987 Furse et al.
4,711,326 A 12/1987 Baugh et al.
4,842,083 A 6/1989 Raney
4,877,092 A 10/1989 Helm et al.
4,889,197 A 12/1989 Boe
5,139,098 A 8/1992 Blake
5,175,429 A 12/1992 Hall, Jr. et al.
5,211,241 A 5/1993 Mashaw, Jr. et al.
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,368,114 A * 11/1994 Tandberg et al. ..... 175/267
5,375,662 A 12/1994 Echols, III et al.
5,402,856 A 4/1995 Warren et al.
5,402,859 A 4/1995 Boberg et al.
5,413,180 A 5/1995 Ross et al.
5,437,308 A 8/1995 Morin et al.
5,443,129 A 8/1995 Bailey et al.
5,495,899 A 3/1996 Pastusek et al.
5,497,842 A 3/1996 Pastusek et al.
5,518,073 A 5/1996 Manke et al.
5,558,162 A 9/1996 Manke et al.
5,560,440 A 10/1996 Tibbits
5,647,437 A 7/1997 Braddick et al.
5,740,864 A 4/1998 de Hoedt et al.
5,746,274 A 5/1998 Voll et al.
5,765,653 A 6/1998 Doster et al.
5,788,000 A 8/1998 Maury et al.
5,823,254 A 10/1998 Dobson et al.
5,853,054 A 12/1998 McGarian et al.
5,862,870 A 1/1999 Hutchinson
5,957,223 A 9/1999 Doster et al.
5,992,518 A 11/1999 Whitlock
6,059,051 A 5/2000 Jewkes et al.
6,070,677 A * 6/2000 Johnston, Jr. ..... 175/57
RE36,817 E 8/2000 Pastusek et al.
6,131,662 A 10/2000 Ross
6,131,675 A 10/2000 Anderson
6,179,066 B1 1/2001 Nasr et al.
6,213,226 B1 4/2001 Eppink et al.
6,227,312 B1 * 5/2001 Eppink et al. ..... 175/57
6,289,999 B1 9/2001 Dewey et al.
6,325,151 B1 12/2001 Vincent et al.
6,328,117 B1 12/2001 Berzas et al.
6,360,831 B1 3/2002 Akesson et al.
6,378,632 B1 4/2002 Dewey et al.
6,494,272 B1 12/2002 Eppink et al.
6,499,537 B1 12/2002 Dewey et al.
6,615,933 B1 9/2003 Eddison
6,651,756 B1 11/2003 Costo, Jr. et al.
6,668,936 B2 12/2003 Williamson, Jr. et al.
6,668,949 B1 12/2003 Rives
6,695,080 B2 2/2004 Presley et al.
6,702,020 B2 3/2004 Zachman et al.
6,732,817 B2 5/2004 Dewey et al.
6,739,416 B2 5/2004 Presley et al.
6,880,650 B2 4/2005 Hoffmaster et al.
6,886,633 B2 5/2005 Fanuel et al.
6,920,930 B2 7/2005 Allamon et al.
6,920,944 B2 * 7/2005 Eppink et al. ..... 175/53
6,991,046 B2 1/2006 Fielder et al.
7,021,389 B2 4/2006 Bishop et al.
7,036,611 B2 5/2006 Radford et al.
7,048,078 B2 * 5/2006 Dewey et al. ..... 175/57
7,069,775 B2 7/2006 Fredette et al.
7,083,010 B2 8/2006 Eppink et al.
7,100,713 B2 9/2006 Tulloch
7,108,067 B2 * 9/2006 Themig et al. ..... 166/317
7,234,542 B2 6/2007 Vail, III
7,252,163 B2 8/2007 Ollerenshaw et al.
7,287,603 B2 10/2007 Hay et al.
7,293,616 B2 11/2007 Tulloch
7,308,937 B2 12/2007 Radford et al.
7,314,099 B2 1/2008 Dewey et al.
7,325,630 B2 2/2008 Takhaundinov et al.
7,451,836 B2 11/2008 Hoffmaster et al.
7,493,971 B2 2/2009 Nevlud et al.
7,506,703 B2 * 3/2009 Campbell et al. ..... 175/265
7,513,318 B2 4/2009 Underwood et al.
7,549,485 B2 6/2009 Radford et al.
7,658,241 B2 * 2/2010 Lassoie et al. ..... 175/57
2001/0017224 A1 8/2001 Evans et al.
2004/0134687 A1 7/2004 Radford et al.
2005/0145417 A1 * 7/2005 Radford et al. ..... 175/57
2005/0241856 A1 11/2005 Lassoie et al.
2005/0274546 A1 12/2005 Fanuel et al.
2005/0284659 A1 12/2005 Hall et al.
2006/0113113 A1 * 6/2006 Underwood et al. ..... 175/61
2006/0118339 A1 6/2006 Takhaundinov et al.
2006/0124317 A1 * 6/2006 Telfer ..... 166/381
2006/0144623 A1 * 7/2006 Ollerensaw et al. ..... 175/269
2006/0207801 A1 9/2006 Clayton
2006/0249307 A1 11/2006 Ritter et al.
2007/0017707 A1 1/2007 Fanuel et al.
2007/0017708 A1 * 1/2007 Radford et al. ..... 175/296
2007/0089912 A1 * 4/2007 Eddison et al. ..... 175/269
2008/0105464 A1 5/2008 Radford
2008/0110678 A1 5/2008 Radford et al.
2008/0128169 A1 * 6/2008 Radford et al. ..... 175/57
2008/0128174 A1 6/2008 Radford et al.
2008/0128175 A1 6/2008 Radford et al.
2009/0145666 A1 6/2009 Radford et al.
2009/0242277 A1 10/2009 Radford et al.
2010/0224414 A1 9/2010 Radford et al.

FOREIGN PATENT DOCUMENTS

EP 19940594420 4/1994
EP 1188898 A2 3/2002
EP 1614852 1/2006
GB 2420803 6/2006
GB 2393461 10/2006
GB 2426269 2/2007
RU 2172385 3/2000
WO 2007017651 2/2007

OTHER PUBLICATIONS

Merriam-Webster Dictionary, Defintions of "Retain" (1 page) and "Keep" (3 pages) accessed by examiner on May 20, 2010 from www.merriam-webster.com.
U.S. Appl. No. 12/416,386, filed Apr. 1, 2009, entitled "Compound Engagement Profile on a Blade of a Down-Hole Stabilizer and Methods Therefor," by Steven R. Radford, 20 pages.
International Search Report for PCT/US2007/024796, dated Jul. 11, 2008, 7 pages.
International Search Report for International Application No. PCT/US2009/038194, mailed Nov. 9, 2009, 4 pages.
Written Opinion of the International Searching Authority for PCT/US2007/024796, dated Jul. 11, 2008, 10 pages.
PCT International Search Report for International Application No. PCT/US2007/024795, mailed May 28, 2008, 5 pages.
U.S. Appl. No. 12/058,384, filed Mar. 28, 2008, entitled "Stabilizer and Reamer System Having Extensible Blades and Bearing Pads and Method of Using Same," by Radford et al., 26 pages.
U.S. Appl. No. 12/501,688, filed Jul. 13, 2009, entitled "Stabilizer Ribs on Lower Side of Expandable Reamer Apparatus to Reduce Operating Vibration", by Radford et al., 72 pages.
Written Opinion of the International Searching Authority for PCT/US2007/024795, mailed May 28, 2008, 6 pages.

Written Opinion of the International Searching Authority for PCT/US2009/038194, mailed Nov. 9, 2009, 4 pages.

Radford, Steven, et al., "Novel Concentric Expandable Stabilizer Results in Increased Penetration Rates and Drilling Efficiency with Reduced Vibration," SPE/IADC 119534, prepared for presentation at the SPE/IADC Drilling Conference and Exhibition held in Amsterdam, The Netherlands, Mar. 17-19, 2009, 13 pages.

International Search Report for International Application No. PCT/US2010/041676 mailed Feb. 22, 2011, 4 pages.

International Written Opinion for International Application No. PCT/US2010/041676 mailed Feb. 22, 2011, 3 pages.

International Search Report for International Application No. PCT/US2010/025867 mailed Oct. 15, 2010, 3 pages.

International Written Opinion for International Application No. PCT/US2010/025867 mailed Oct. 15, 2010, 6 pages.

Written Opinion of the International Searching Authority for PCT/US2009/042511, mailed Dec. 1, 2009.

* cited by examiner

STABILIZER AND REAMER SYSTEM HAVING EXTENSIBLE BLADES AND BEARING PADS AND METHOD OF USING SAME

CROSS-REFERENCE TO RELATED APPLICATIONS

This application claims the benefit of U.S. provisional patent application Ser. No. 61/049,617, filed May 1, 2008. The subject matter of this application is related to U.S. patent application Ser. No. 13/038,564, filed Mar. 2, 2011, pending, which is a continuation of U.S. patent application Ser. No. 11/949,259, filed Dec. 3, 2007, now U.S. Pat. No. 7,900,717, issued Mar. 8, 2011; U.S. patent application Ser. No. 11/949,405, filed Dec. 3, 2007, pending; U.S. patent application Ser. No. 12/058,384, filed Mar. 28, 2008, now U.S. Pat. No. 7,882,905, issued Feb. 8, 2011; U.S. patent application Ser. No. 12/715,610, filed Mar. 2, 2010, pending; and U.S. patent application Ser. No. 12/501,688, filed Jul. 13, 2009, pending.

TECHNICAL FIELD

Embodiments of the present invention relate generally to a system for drilling a subterranean borehole and, more particularly, to a system having at least two independently actuatable downhole assemblies, such as at least one expandable reamer and at least one expandable stabilizer, respectively having extensible blades and bearing pads for enlarging a subterranean borehole beneath a casing or liner, and including methods of use therefor.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while also providing requisite shoring for subsequent drilling operation to achieve greater depths. Casing is also conventionally installed to mutually isolate different formations, to prevent crossflow of formation fluids, and to enable control of formation fluids and pressure as the borehole is being drilled. To increase the depth of a previously drilled borehole, new and smaller diameter casing (such term including liner) is disposed within and extended below the previous casing. However, while adding additional casing allows a borehole to reach greater depths, the additional, smaller casing has the disadvantage of narrowing the borehole. Narrowing the borehole restricts the diameter of any subsequent sections of the well because the drill bit and any further casing must pass through the smaller casing. As reductions in the borehole diameter are undesirable because they limit the production flow rate of oil and gas through the borehole, it is often desirable to enlarge a subterranean borehole to provide a larger borehole diameter beyond previously installed casing to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, assigned to the assignee of the present invention. A bi-center bit assembly employs two longitudinally superimposed bit sections with laterally offset axes, which when rotated produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom-hole assembly with a pilot drill bit at the distal end thereof and a reamer assembly located at a proximal distance above. This arrangement permits the use of any conventional rotary drill bit type, be it a rock bit or a drag bit, as the pilot bit, and the associated extended nature of the assembly permit greater flexibility when passing through tight spots in the borehole, as well as the opportunity to effectively stabilize the pilot drill bit so that the pilot hole and the following reamer will traverse the path intended for the borehole. This aspect of an extended bottom-hole assembly (BHA) is particularly significant in directional drilling. The assignee of the present invention has, to this end, designed reaming structures as so-called "reamer wings," which generally comprise a tubular body having a fishing neck with a threaded connection at the top thereof and a tong die surface at the bottom thereof, also with a threaded connection. U.S. Pat. Nos. 5,497,842 and 5,495,899, both assigned to the assignee of the present invention, disclose reaming structures including reamer wings. The upper mid-portion of the reamer wing tool includes one or more longitudinally extending blades projecting generally radially outwardly from the tubular body, the outer edges of the blades carrying PDC cutting elements.

As mentioned above, conventional expandable reamers may be used to enlarge a subterranean borehole and may include blades pivotably or hingedly affixed to a tubular body and actuated by way of a piston disposed therein as disclosed by U.S. Pat. No. 5,402,856 to Warren et al. In addition, U.S. Pat. No. 6,360,831 to Åkesson et al. discloses a conventional borehole opener comprising a body equipped with at least two hole-opening arms having cutting means that may be moved from a position of rest in the body to an active position by exposure to pressure of the drilling fluid flowing through the body. The blades in these reamers are initially retracted to permit the tool to be run through the borehole on a drill string and once the tool has passed beyond the end of the casing, the blades are extended so the well bore diameter may be increased below the casing.

The blades of these conventional expandable reamers utilize pressure from inside the tool to apply force radially outward against pistons which move the blades, carrying cutting elements, laterally outward. Still other conventional reamers utilize pressure from inside the tool to apply force axially against a piston which forces attached blades, carrying cutting elements, laterally outward. Still further, fluid-and pressure-operated expandable reamers are disclosed in U.S. patent application Ser. Nos. 11/875,241, 11/873,346, 11/949,259, and 11/949,627, each of which is assigned to the assignee of the present invention and the disclosure of each of which application is incorporated herein in its entirety by this reference, overcome some of the difficulties associated with conventional expandable reamers while providing for enhanced lateral movement of the blades.

Various approaches to drill and/or ream a larger diameter borehole below a smaller diameter borehole may include stabilizer blocks or pads used longitudinally above or below an expandable reamer to increase stability and reduce dysfunctional loads, i.e., lateral vibrational loading, thereupon while reaming. Use of stabilizers to improve the drilling performance of an expandable reamer is generally known to a person of ordinary skill in the art. In most instances, fixed stabilizer pads or blocks, being sized and configured for a corresponding hole diameter cut by a pilot bit or drill bit, are located in a drill string between the bit and the expandable reamer. It is recognized that an expandable reamer may be run through a borehole without a pilot bit or drill bit, particularly when reaming or expanding an existing borehole. The stabilizer pads or blocks help to control stability, particularly when conducting a so-called "down drill" operation, e.g., drilling in the down-hole direction. Also, as understood by a person of skill in the art, stability is further improved by providing a point of control above an expandable reamer to decrease the flexibility of the drill string about the expandable reamer. In this respect, an expandable reamer may include, when used in "down drill" operations, expandable stabilizer blocks or pads above the reamer. The expandable stabilizer blocks or pads are also known as expandable stabilizers, such as the movable bearing pad structure disclosed in U.S. patent application Ser. No. 11/875,241 referenced above, such apparatus being operated to an expanded state by the flow of fluid, such as drill mud, or pressure within the drill string. The expandable stabilizer blocks or pads may also be included in the drill string below the expandable reamer, either by replacing or augmenting the function of the fixed stabilizer pads or blocks. The expandable reaming blocks or pads, when placed above an expandable reamer, are conventionally sized and configured to extend to a diameter corresponding to the reamed borehole diameter.

The fixed and expandable stabilizer blocks or pads may be integral with a tool body of an expandable reamer or may be included with other down-hole tools serially connected above and/or below an expandable reamer, such as part of a drill bit or a stabilizer tool. The expandable reamers and the expandable stabilizers, operated by the flow of fluid or pressure within respective flow bores, overcome some of the limitations associated with bi-center and reamer wing assemblies in the sense that the pass-through diameter of such tools is nonadjustable and limited by the reaming diameter; and improves upon the tendency associated with conventional bi-center and eccentric bits to wobble and deviate from the path intended for the borehole. Moreover, the fluid-or pressure-operated expandable reamers and expandable stabilizers may overcome other limitations associated with conventional expandable reaming assemblies, such as being subject to damage when passing through a smaller diameter borehole or casing section, becoming prematurely actuated, and difficulties in removal through the casing after actuation.

Notwithstanding the various prior approaches to drill and/or ream a larger diameter borehole below a smaller diameter borehole, a need exists for improved apparatus, systems or methods for doing so. For instance, conventional systems for stabilizing while reaming a borehole (especially while back-reaming a drilled borehole) may encounter subterranean formation changes within the formation of the drilled borehole (i.e., a tight spot of swelled shale or filter cake in the formation, or other obstructions) making retraction of the stabilizer and reamer necessary while trimming or back-reaming, this being undesirable in that an under-gage borehole results. Thus, encountering changes in the previously reamed formation may necessitate deactivation (retraction) of an expandable reamer and stabilizer (particularly because the expandable reamer and stabilizer are activated, i.e., initially triggered, simultaneously by a single actuating device, i.e., a drop ball) in order to trip back up the borehole and then begin reaming again in the down-hole direction in order to trim the borehole to the proper diameter.

Accordingly, there is an ongoing desire to improve or extend performance of a stabilizer and reamer system having extensible blades and bearing pads for enlarging a subterranean borehole beneath a casing, including a method of use therefor. There is a further desire to provide a stabilizer and reamer system having extensible blades and bearing pads capable of independent, or consecutive, initial activation or triggering.

BRIEF SUMMARY OF THE INVENTION

Independent activation or triggering of the blades of an expandable reamer and the bearing pads of an expandable stabilizer as a system are provided. Independent activation of the reamer and stabilizer will provide a degree of control over the stabilizer, which is used to stabilize the reamer, without necessarily having to initiate both tools at the same time. For example, the reamer may be activated or triggered by a first actuation device to allow the pressure of fluid flowing through the reamer's body to extend the blades outward, without necessarily having to extend the bearing pads of the stabilizer, located longitudinally above the reamer, advantageously allowing the reamer to ream in the up-hole direction with the bearing pads of the stabilizer in their initial or retracted position without being forced upon or impinging (under the force of hydraulic fluid) against the walls of the to-be-reamed borehole. When downhole reaming is desired or the stabilizer blades are to be released (i.e., triggered) from their retracted or initial position, a second actuation device may be used to activate or trigger the stabilizer.

Optionally, the up-hole device may be a second expandable reamer allowing the downhole reamer to be actuated before the second reamer is actuated, released, or triggered. Embodiments of the invention may optionally be used with an expandable stabilizer during upward movement in a borehole, or for enabling a reamed or drilled borehole to be trimmed more efficiently in the up-hole direction while simultaneously providing reduced lateral vibration in the bottom-hole assembly, particularly when it is desired to extend, by triggering, the blades of the expandable stabilizer to their fullest extent for reaming in the down-hole direction.

The invention may be used with systems for drilling subterranean boreholes and, more particularly, to apparatus having consecutively initiated extensible blades and bearing pads, and methods of use thereof, for enlarging a subterranean borehole below a restriction, such as casing or liner. Furthermore, the invention relates to improved methods and apparatus for improving stabilization of a drilling assembly while under-reaming in either the down-hole or up-hole directions and controlling directional tendencies and reducing undesirable vibrational effects of the drilling assembly within an enlarged borehole. Optionally, the invention may be used with an expandable stabilizer provided with up-hole cutting structures upon the bearing pads of the expandable stabilizer for trimming a previously enlarged subterranean borehole, particularly when so-called "back-reaming" of the enlarged borehole is desired and when the bearing pads of an expandable stabilizer are subsequently expanded to the same lateral extent as the extensible blades of the expandable reamer.

In accordance with an embodiment of the invention, a drilling system for enlarging a borehole includes an expandable reamer and an expandable stabilizer axially coupled above the expandable reamer. The expandable reamer includes a tubular body having a longitudinal axis and a drilling fluid flow path therethrough, a plurality of generally radially and longitudinally extending blades carried by the tubular body, a first triggering device carried by the tubular body for initially retaining the blades in a retracted or initial position, and a cutting structure carried by at least one blade of the plurality of blades, wherein the at least one blade of the plurality of blades is movable outwardly, with respect to the longitudinal axis upon application of fluid pressure after the first triggering device is triggered by a first actuation device, such as a drop ball sized to pass through the bore of the expandable stabilizer without triggering expansion of the bearing pads thereof. The expandable stabilizer includes a tubular body having a longitudinal axis and a drilling fluid flow path therethrough, a plurality of generally radially and longitudinally extending bearing pads carried by the tubular body, and a second triggering device carried by the tubular body for initially retaining the bearing pads in a retracted or initial position, wherein at least one bearing pad of the plurality of bearing pads is movable outwardly with respect to the longitudinal axis upon application of fluid pressure after the second triggering device is triggered by a second actuation device. The second actuation device is designed to trigger the stabilizer, while the first actuation device is designed to pass through the stabilizer and trigger the reamer. For example, the second actuation device may be a larger drop ball sized to engage the second triggering device.

Methods for sequentially actuating expandable stabilizers and/or reamers are also provided.

Other advantages and features of the present invention will become apparent when viewed in light of the detailed description of the various embodiments of the invention when taken in conjunction with the attached drawings and appended claims.

DETAILED DESCRIPTION OF THE INVENTION

The illustrations presented herein are, in most instances, not actual views of any particular reamer tool, stabilizer tool, drill string, cutting element, or other feature of a stabilizer and reamer system of a drilling assembly, but are merely idealized schematic representations that are employed to describe the present invention. Additionally, elements common between figures may retain the same numerical designation. Moreover, the lateral and longitudinal dimensions shown in the figures are merely idealized representations, as the actual dimensions are expected to vary according to specific application requirements in the field.

Figure 1:
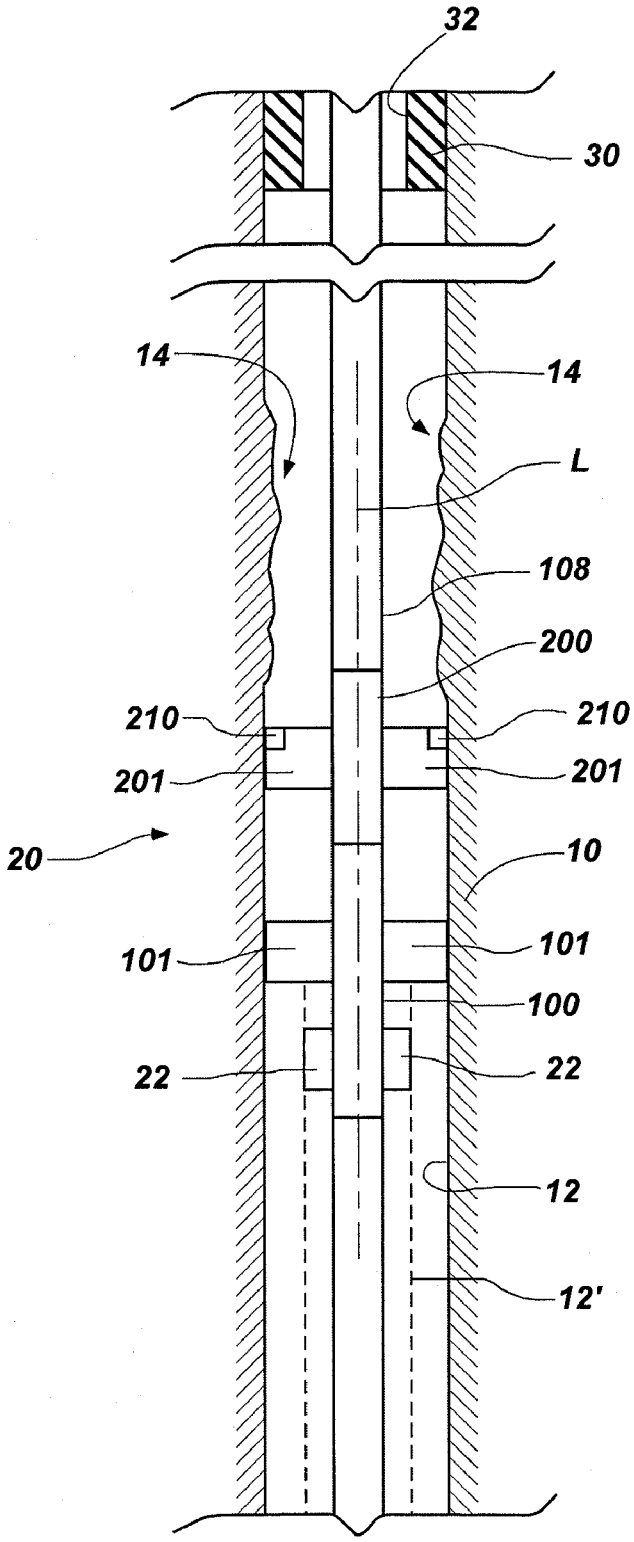
FIG. 1 is a longitudinal schematic view of a drilling assembly in accordance with an embodiment of the invention.

FIG. 1 is a longitudinal schematic view of a drilling assembly in accordance with an embodiment of the invention. A section of a drilling assembly generally designated by reference numeral 20 is shown reaming a borehole 12 extending through a formation 10 with an expandable reamer 100 followed by an expandable stabilizer 200. The expandable reamer 100 and the expandable stabilizer 200, respectively, include reamer blades 101 and bearing pads, or stabilizer blades 201 expanded to their full lateral extent for reaming and stabilizing the drilling assembly 20. The expandable stabilizer 200 may be adjacently located coaxially with the expandable reamer 100 in the drilling assembly 20 or separated by one or more drill pipe segments (not shown) in the drilling assembly 20. Optionally, the expandable reamer 100 and the expandable stabilizer 200 may comprise a single tool having a unitary body, of the drilling assembly 20. In any case, the expandable reamer 100 and the expandable stabilizer 200 are coupled together coaxially along a common central or longitudinal axis L of the drilling assembly 20. The expandable stabilizer 200 helps to control directional tendencies of the drilling assembly 20, reduces vibration, and stabilizes the expandable reamer 100 as the borehole 12 is reamed to a larger diameter beneath a smaller diameter borehole 32 of a casing or liner 30. This section of the drilling assembly 20 is shown having reamed the diameter of borehole 32 in the "down-hole" direction with the reamer blades 101 carrying cutting elements (not shown) thereon while being fully extended, and now back-reaming in the "up-hole" direction while the stabilizer blades 201, configured with cutting structures 210 on their up-hole surfaces, remove, by trimming, formation material from the wall of the borehole 12 while still providing stabilization for the drilling assembly 20. In this respect, the drilling assembly 20 provides capability for reaming while stabilizing in either direction within borehole 12 without having to retract respective blades 101 and 201 of the expandable reamer 100 and expandable stabilizer 200, respectively, in order to clear obstructions in the borehole 12, such as slump, swelled shale or filter cake, or other borehole obstructions and/or anomalies existing or occurring after reaming portions of the borehole 12.

The drilling assembly 20 of the present invention allows reaming and stabilizing to be provided in either direction without having to deactivate the expandable reamer 100 and the expandable stabilizer 200 in order to retract the blades 101 and 102, respectively, in order to get past a section of formation 10 encroaching on (i.e., by formation slumping, formation swelling, or caking upon the borehole wall) the previously reamed or drilled borehole 12. The formation slump or swell, or caking in borehole 12 is indicated generally by reference numeral 14. The drilling assembly 20 enables reaming in the down-hole direction and then back-reaming in the up-hole direction without having to deactivate the expandable stabilizer 200 in order to bypass formation irregularities (shown at reference numeral 14) in the borehole 12. Another advantage afforded with the drilling assembly 20 is the ability to ream and then back-ream, without retraction of the stabilizer blades 201, to get past a restriction 14 in the borehole 12 of the formation 10, particularly when the expandable blades 101 and 201 of the expandable reamer 100 and the expandable stabilizer 200, respectively, are activated and deactivated by the same operational mechanism, such as hydraulic flow of drilling fluid through the flow bore (not shown) of the drilling assembly 20.

Figure 4:
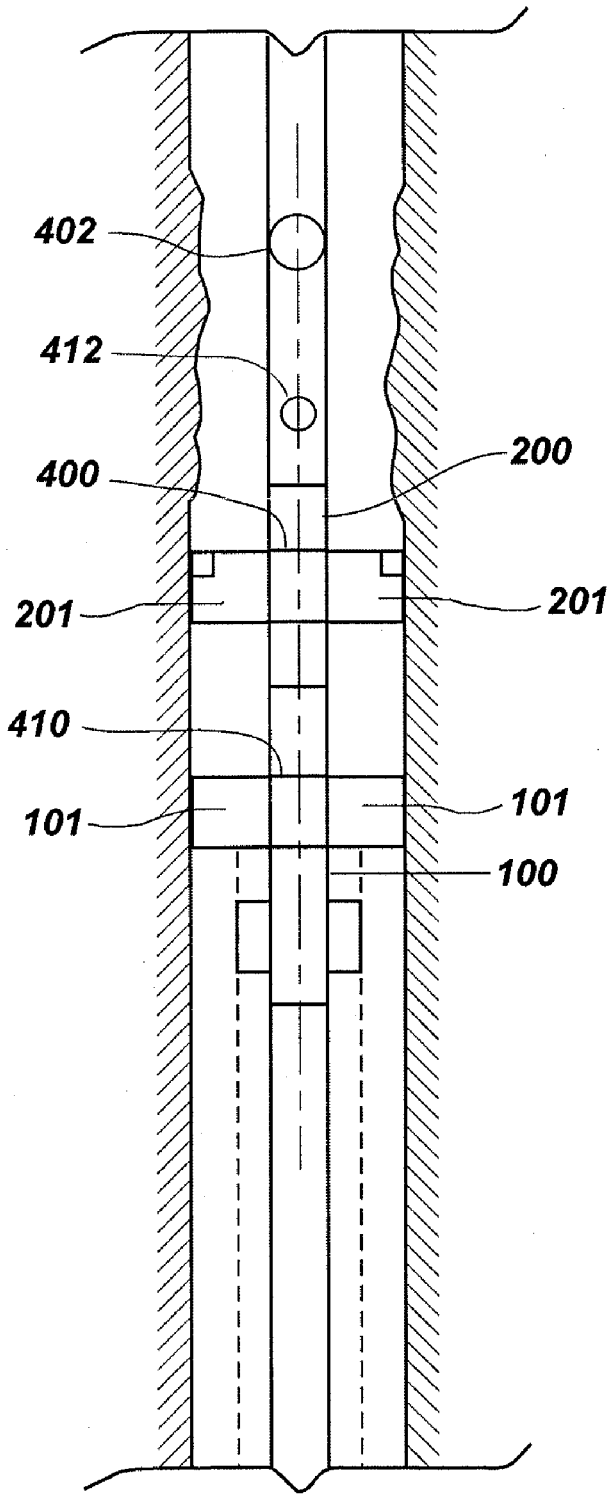
FIG. 4 is a longitudinal schematic view of a drilling assembly in accordance with an embodiment of the invention.

In accordance with this embodiment of the invention and as shown in FIG. 4, the expandable stabilizer 200, located above (in the axial up-hole direction) the expandable reamer 100, includes a second triggering device 400 that is selectively actuatable by a second actuation device 402, which, when triggered, allows fluid pressure to act upon and extend the stabilizer blades 201. Similarly, the expandable reamer 100 includes a first triggering device 410 that is selectively actuatable by a first actuation device 412, which, when triggered, allows fluid pressure to act upon and extend the reamer blades 101, and the first actuation device 412 may pass through the body of the expandable stabilizer 200 without triggering the expandable stabilizer 200. The actuation devices 402, 412 and the triggering devices 400, 410 may be operationally configured as provided for and described in U.S. patent application Ser. No. 11/949,259 ("'259 reference"), entitled "EXPANDABLE REAMERS FOR EARTH BORING APPLICATIONS," the disclosure of which is incorporated herein in its entirety by this reference. For example, the first actuation device 412 may be a drop ball having a one and seven-eighths of an inch diameter for reception into the first triggering device 410 (i.e., a ball trap sleeve as provided for in the above-incorporated '259 reference and configured for trapping a one and seven-eighths inch diameter ball), while the second actuation device 402 may be a drop ball having a two-inch diameter for reception into second triggering device 400 (i.e., a ball trap sleeve as provided for in the above-incorporated '259 reference and configured for trapping a two-inch diameter drop ball). The first actuation device 412 may pass through the second triggering device 400 under the influence of drilling fluid flow, un-occluded therein, enabling only the expandable reamer 100 to be triggered and subsequently actuated. Thereafter, the second actuation device 402 may be used to trigger the expandable stabilizer 200. Accordingly, the expandable reamer 100 is triggered first, and then the expandable stabilizer 200 may be triggered.

Optionally, another expandable reamer (not shown) may be positioned axially above the expandable reamer 100 having yet another triggering device that is triggered by another actuating device of still another, different size from the first and second triggering devices 400,410. In this respect, the expandable reamer 100 and then the another expandable reamer may be sequentially triggered. Also, the expandable reamer 100, the expandable stabilizer 200, and the another expandable reamer may each be sequentially triggered based upon their location and configuration within the drill string, respectively. The method for triggering and actuating the blades 101, 201 of each device are provided for in the above-incorporated '259 reference.

As also shown in FIG. 1, the drilling assembly 20 may also include conventional fixed stabilizer blades or bearing pads 22 configured for allowing the drilling assembly 20 to pass through the borehole 32 of the casing or liner 30 while being sized to provide stabilization behind a drill bit (not shown) as it drills a smaller borehole 12' (shown in broken lines) than the expanded borehole 12 through the formation 10. Moreover, the fixed stabilizer blades 22 provide stabilizing support for the expandable reamer 100 thereabove due to their presence in the smaller borehole 12' being drilled as the expandable reamer 100 enlarges the borehole diameter to that of borehole 12 when drilling in the down-hole direction through the smaller borehole 12', while the expandable stabilizer 200 provides stabilizing support for the expandable reamer 100 in the expanded borehole 12.

Figure 2:
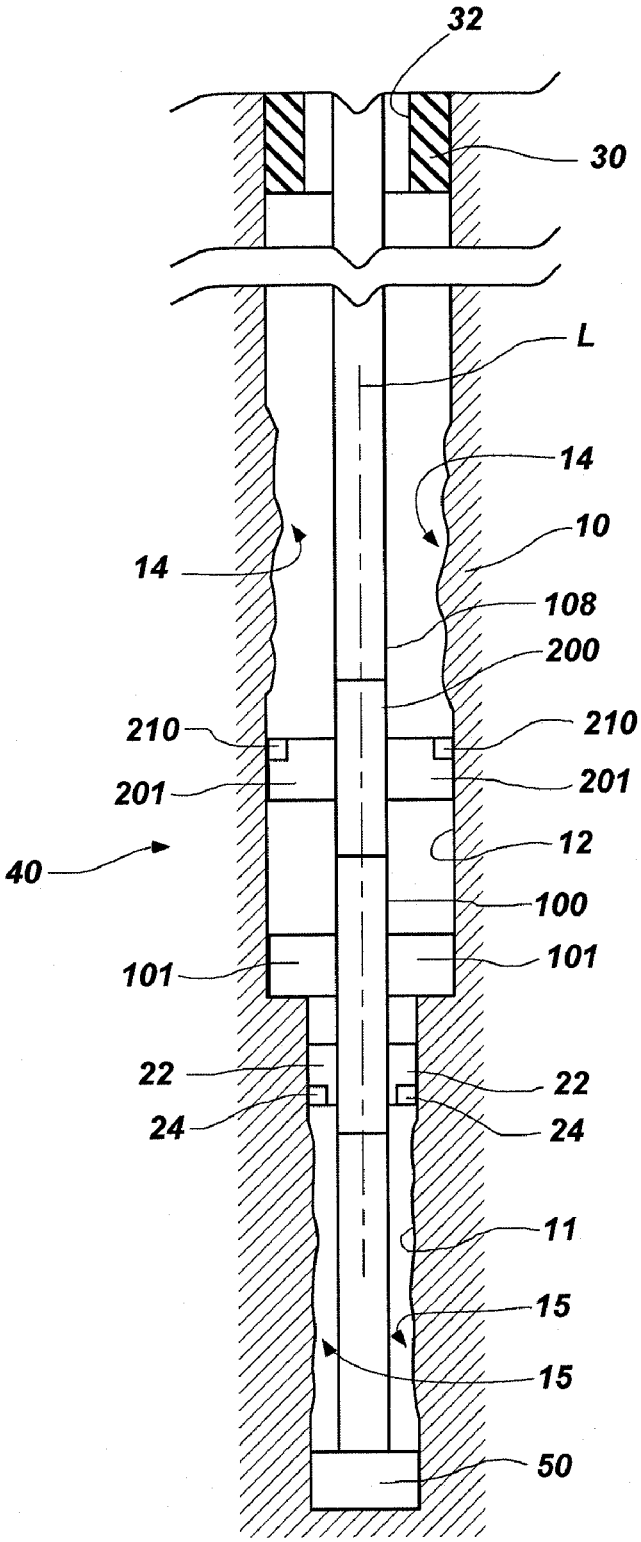
FIG. 2 is a longitudinal schematic view of a drilling assembly in accordance with another embodiment of the invention.

FIG. 2 shows a longitudinal schematic view of a drilling assembly 40 in which selective sequential triggering in accordance with the invention may be used, as described herein, wherein like reference numerals previously employed in FIG. 1 represent like components. A section of the drilling assembly 40 is shown reaming a formation 10 in the down-hole direction with an expandable reamer 100 followed by an expandable stabilizer 200, both the expandable reamer 100 and the expandable stabilizer 200, respectively, being expanded to their full lateral extent. The expandable stabilizer 200 helps to control directional tendencies or reduce vibrations of the drilling assembly 40 and stabilizes the expandable reamer 100 as a borehole 12 is enlarged to a larger diameter below a smaller diameter borehole 32 in a casing or liner 30. The section of the drilling assembly 40 is shown as having enlarged the diameter of borehole 32 in the "down-hole" direction as fully extended reamer blades 101 carrying cutting elements (not shown) remove the material of the formation 10, while the expandable reamer 100 is stabilized by the expandable stabilizer 200 making stabilizing contact with the wall of the larger borehole 12 as it follows the expandable reamer 100 and is further stabilized by fixed stabilizer blades or bearing pads 22 that are in stabilizing contact with the wall of a drilled borehole 11 below expandable reamer 100. As with the embodiment of the invention shown in FIG. 1, stabilizer blades 201 of the expandable stabilizer 200 are configured with cutting structures 210 for removing, clearing, or trimming obstructions on the wall of the borehole 12 caused by the formation 10, such as slump, swelled shale or filter cake, or other anomalies reducing the size of, or causing irregularities (generally referenced by numeral 14) in the shape of the borehole 12 when the drilling assembly 40 back-reams the borehole 12.

Additionally, the fixed stabilizer blades 22 may be configured with cutting structures 24 upon their down-hole surfaces for removing or clearing obstructions (generally referenced by numeral 15) on the wall of the borehole 11 formed in the subterranean formation 10 by a drill bit 50. The obstructions 15 may form as formation slump or swelled shale, or filter cake deposited upon the wall of the borehole 11 after the borehole 11 is drilled by the drill bit 50, or may comprise other anomalies in the borehole 11 size or shape. In this embodiment, the cutting structures 24 upon the fixed stabilizer blades 22 provide for removal of obstructions 15 that may impede smooth passage as the fixed stabilizer blades 22 pass through the borehole 11 of formation 10 while providing stability desired for the expandable reamer 100 during the drilling and reaming operation. Moreover, the fixed stabilizer blades 22 are sized and configured for allowing the drilling assembly 40 to pass through the borehole 32 of the casing or liner 30, while also being sized and configured to provide stabilization behind the drill bit 50 as it drills the pilot borehole 11. In this respect, the fixed stabilizer blades 22 provide stabilizing support in the pilot borehole 11 for the expandable reamer 100 as it enlarges the borehole diameter to that of borehole 12 during down-hole drilling, while the expandable stabilizer 200 provides stabilizing support for the expandable reamer 100 in the expanded borehole 12, above the expandable reamer 100.

In other embodiments, the fixed stabilizer blades or bearing pads 22 may be designed and configured for allowing the drilling assembly 40 to pass through the borehole 32 of the casing or liner 30, while also being sized and configured to provide stabilization behind a drill bit 50 having a reduced lateral diameter as it drills a pilot borehole 11. Fixed stabilizer blades or bearing pads 22 are allowed to make stabilizing contact with pilot borehole 11 drilled by the drill bit 50.

The expandable reamer 100 and/or the expandable stabilizer 200 of the drilling assembly 20 and the drilling assembly 40, according to the embodiments of the invention, as shown in FIG. 1 or 2, may include a generally cylindrical tubular body 108 having the longitudinal axis L. The tubular body 108 may have a lower end and an upper end. The terms "lower" and "upper," as used herein with reference to the ends, refer to the typical positions of the ends relative to one another when the drilling assembly is positioned within a well bore. The lower end of the tubular body 108 of the expandable reamer 100 may include a set of threads (e.g., a male-threaded pin member) for connecting the lower end to another section of a drill string or another component of a bottom-hole assembly (BHA), such as, for example, a drill collar or collars carrying a pilot drill bit 50 (shown in FIG. 2) for drilling a well bore. Similarly, the upper end of the tubular body 108 of the expandable reamer 100 may include a set of threads (e.g., a female-threaded box member) for connecting the upper end to another section of a drill string or another component of a bottom-hole assembly (BHA).

Typically, the expandable reamer 100 and the expandable stabilizer 200 may include a plurality of sliding cutter blocks or reamer blades 101 and a plurality of stabilizer blades or bearing pads 201, respectively, that are positionally retained in circumferentially spaced relationship in the tubular body 108 of the respective tool, as further described below, and may be provided at a position between the lower end and the upper end. The blades 101 and 201 may be comprised of steel, tungsten carbide, a particle-matrix composite material (e.g., hard particles dispersed throughout a metal matrix material), or other suitable materials as known in the art. The blades 101 and 201 are retained in an initial, retracted position within the tubular body 108 of the expandable reamer 100 and the expandable stabilizer 200, but may be moved responsive to application of hydraulic pressure into the extended position (shown in FIGS. 1 and 2) and moved back into a retracted position (not shown) when desired. The expandable reamer 100 and the expandable stabilizer 200 may be configured such that the blades 101 and 201, respectively, engage the walls of a subterranean formation surrounding a well bore in which drilling assembly 20 (or 40) is disposed to remove formation material when the blades 101 and 201 are in the extended position, but are not operable to so engage the walls of a subterranean formation within a well bore when the blades 101 and 201 are in the retracted position. While the expandable reamer 100 may conventionally include three reamer blades 101, it is contemplated that one, two or more than three blades may be utilized to improve performance in a given application. While the expandable stabilizer 200 may conventionally include three stabilizer blades 201 it is contemplated that one, two or more than three blades may be utilized to advantage. Moreover, in one embodiment, the blades 101 and 201 are symmetrically circumferentially positioned axially along the tubular body 108, and in other embodiments, the blades may also be positioned circumferentially asymmetrically as well as asymmetrically along the longitudinal axis L in the direction of either end.

Figure 3:
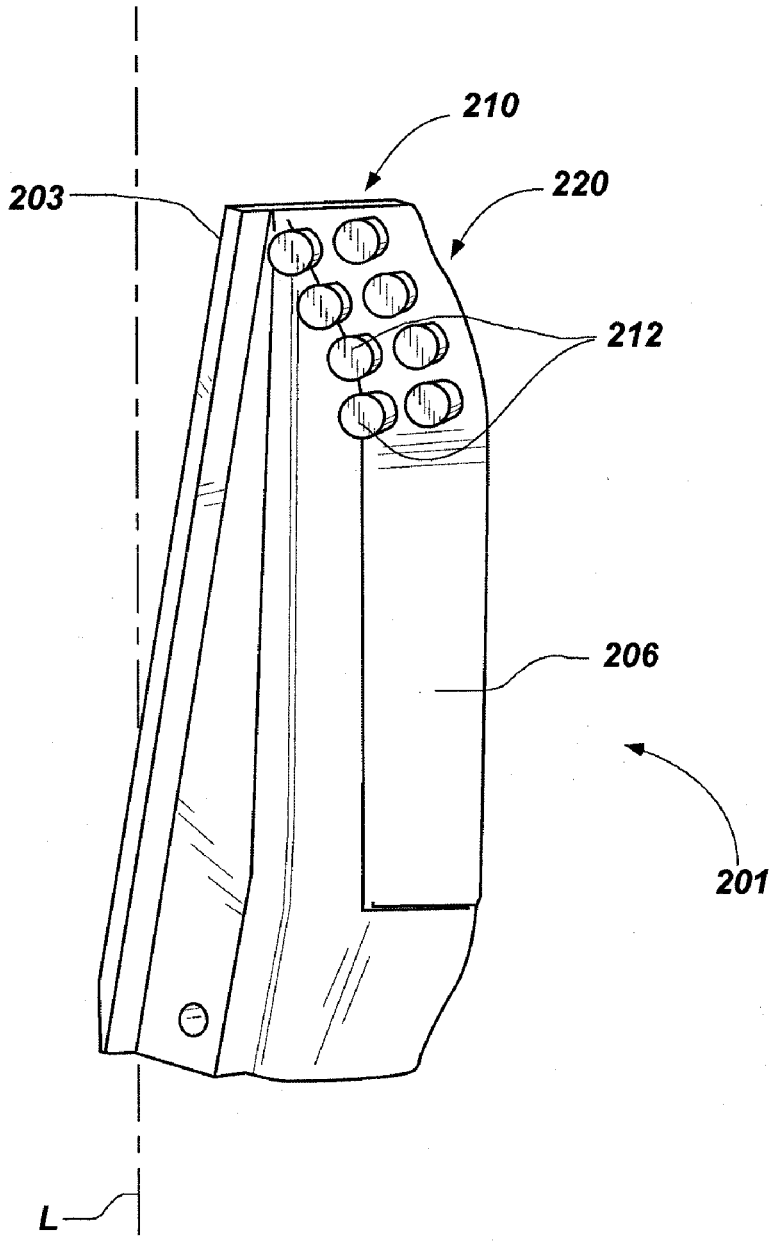
FIG. 3 is a longitudinal perspective view of a stabilizer blade suitable for use in accordance with embodiments of the invention.

The blades 101 and 201 of either of the expandable reamer 100 or the expandable stabilizer 200 may be operationally configured to extend or retract within the tubular body 108 as described in U.S. patent application Ser. No. 11/949,259, mentioned above, and the disclosure of which is incorporated herein in its entirety by this reference. Optionally, any conventional expandable reamer or expandable stabilizer modified and reconfigured in accordance with the teachings of the invention herein may be utilized to advantage to provide an improved system or drilling assembly for stabilizing the drill string while reaming, particularly when back-reaming. For example, any one or all of the blades of such conventional reamer or stabilizer may be replaced with a stabilizer blade 201, as shown in FIG. 3, configured in accordance with the invention herein presented. Specifically, the stabilizer blade 201 is configured to extend laterally and axially outward upon the application of hydraulic fluid pressure flowing through the drilling assembly as provided for in the U.S. patent application Ser. No. 11/949,259, however, it is also recognized that the stabilizer blade 201 (or the reamer blade 101) may be configured for lateral outward extension by other hydraulic fluid pressure or by any other mechanical means, such as a push rod, wedge or actuating motor or as conventionally understood to a person having ordinary skill in the expandable reamer/stabilizer art.

The invention may also be used with the expandable stabilizer having the stabilizer blade 201, as shown in FIG. 3, that includes a rail 203 for engaging the blade tracks (shown in the incorporated reference) of the tubular body 108 allowing the stabilizer blade 201 to be extended outwardly and retracted inwardly into the drilling assembly 20 or 40 of FIGS. 1 and 2, respectively. The stabilizer blade 201 carries a plurality of cutting elements 212 comprising the cutting structure 210 configured upon an up-hole portion 220 thereof that are for engaging the material of a subterranean formation defining the wall of an open and expanded borehole when the blades 101 and 201 (as described above with respect to FIGS. 1 and 2) are in an extended position. The cutting elements 212 may be polycrystalline diamond compact (PDC) cutters or other cutting elements known to a person of ordinary skill in the art and as generally described in U.S. Pat. No. 7,036,611 entitled "Expandable Reamer Apparatus for Enlarging Boreholes while Drilling and Methods of Use," the entire disclosure of which is incorporated by reference herein. While providing the cutting structure 210 upon the up-hole portion 220, the stabilizer blade 201 further comprises a bearing surface 206 for engaging the wall of the borehole (not shown) during stabilization as is generally understood by a person of ordinary skill in the art. The cutting structure 210 may extend from the bearing surface 206 (i.e., at gage) radially and longitudinally inward on a portion of the up-hole portion 220 of the stabilizer blade 201. Generally, the bearing surface 206 is configured to be substantially parallel to the longitudinal axis L.

Other embodiments of the invention are now provided:

For example, a drilling system for enlarging a borehole in a subterranean formation is provided, comprising an expandable reamer that includes a tubular body having a longitudinal axis and a drilling fluid flow path therethrough, a plurality of generally radially and longitudinally extending blades carried by the tubular body, and a cutting structure carried by at least one blade of the plurality of blades, wherein at least one blade of the plurality of blades is movable outwardly with respect to the longitudinal axis; and an expandable stabilizer axially coupled above the expandable reamer and comprising a tubular body having a longitudinal axis and extending the drilling fluid flow path therethrough, a plurality of generally radially and longitudinally extending bearing pads carried by the tubular body, wherein at least one bearing pad of the plurality of bearing pads includes an up-hole cutting structure carried thereupon and is movable outwardly with respect to the longitudinal axis. Optionally, the expandable reamer may include a plurality of generally radially and longitudinally extending lower bearing pads disposed axially below the plurality of blades and may include down-hole cutting structures carried thereupon.

The drilling system in accordance with embodiments of the invention may comprise a second expandable stabilizer axially coupled below the expandable reamer and comprise a tubular body having a longitudinal axis and a drilling fluid flow path therethrough, a plurality of generally radially and longitudinally extending lower bearing pads carried by the tubular body, wherein at least one lower bearing pad of the plurality of lower bearing pads includes down-hole cutting structure carried thereupon and is movable outwardly with respect to the longitudinal axis. The blades, the bearing pads and the lower bearing pads may be outwardly extensible with respect to the longitudinal axis by a fluid flow or pressure.

In still other embodiments, a stabilizer and reamer system for enlarging a borehole in a subterranean formation includes a tubular drill string assembly having a longitudinal axis, an upper segment, a mid-segment and a drilling fluid flow path therethrough; at least one movable reamer blade carried by the mid-segment; and at least one movable bearing pad carried by the upper segment having an up-hole edge and at least one trim cutter element thereon, wherein the at least one movable bearing pad is outwardly extensible with respect to the longitudinal axis by fluid flow or pressure. The upper segment and the mid-segment may form a unitary portion of the tubular drill string assembly or may be unitary assemblies making up the drill string assembly.

In further embodiments, a reamer-stabilizer system for enlarging a borehole in a subterranean formation comprising a portion of a drill string includes a longitudinal axis, an expandable reamer, an expandable stabilizer axially associated above the expandable reamer, and a drilling fluid flow path therethrough, wherein the expandable stabilizer includes a tubular body, and at least one bearing pad carried by the tubular body being outwardly extensible with respect to the longitudinal axis, responsive to a pressure of drilling fluid passing through the drilling fluid flow path. The at least one bearing pad carries cutting structure thereon for up-hole trimming.

In still further embodiments, an assembly for trimming a subterranean borehole includes at least one laterally movable blade, and at least one laterally movable bearing pad longitudinally spaced above the at least one laterally movable blade and comprising at least one trimming element configured for up-hole strimming.

Methods for trimming a subterranean borehole may include positioning in a borehole, with a drill string, a first tubular body carrying at least one generally laterally movable blade and a second tubular body carrying at least one generally laterally movable bearing pad longitudinally spaced above the at least one laterally movable blade and comprising at least one trimming element configured for up-drilling; moving the at least one generally laterally movable blade into contact with a wall of the borehole with a pressure or fluid flow from within the drill string; moving the at least one generally laterally movable bearing pad into contact with the wall of the borehole with the pressure or fluid flow from within the drill string; and rotating the drill string in the up-hole direction to trim formation material from the wall of the borehole.

Methods for trimming a subterranean borehole may also include substantially concurrently positioning a third tubular body, in the borehole, with the drill string, carrying at least one generally laterally movable second bearing pad longitudinally spaced below the at least one generally laterally movable blade and comprising at least one trimming element configured for down-drilling, and moving the at least one generally laterally movable second bearing pad into contact with the wall of the borehole with the pressure or fluid flow from within the drill string.

In order to prevent a stabilizer and a reamer located within a drill string from being triggered and then actuated simultaneously by a same drop ball, the invention generally includes a reaming system comprising an expandable reamer axially located in a drill string below or above an expandable stabilizer and configured for successive initiation, triggering, and/or actuation. For example, the expandable reamer may be located axially below the expandable stabilizer and include a trap sleeve for receiving a smaller 1.75-inch-diameter ball to trigger the expandable reamer, and the expandable stabilizer may include a larger trap sleeve for receiving a larger 2-inch-diameter ball to trigger the expandable stabilizer. In this respect, the two differently sized drop balls may be used to sequentially trigger the axially lower expandable reamer and then the axially upper expandable stabilizer.

One method in accordance with the invention includes triggering the lower expandable reamer with a smaller ball first. When the smaller ball is dropped (i.e., introduced into the fluid flow of the drill string), it passes through the expandable stabilizer, without effect therein, before seating in the expandable reamer and triggering it. Thereafter, or after the expandable reamer is verified to be operating properly, a larger ball is dropped into the drill string to trigger the axially upper expandable stabilizer. The expandable stabilizer may be located axially above the expandable reamer at any distance, including about 30 feet. Optionally, another reamer may be used in addition to, or in place of, the expandable reamer, each component of the system being selectively sequentially triggered in an axially upward direction in accordance with the present invention. In this respect, progressively larger actuating and triggering devices (i.e., drop balls) extending from the axially most distal expandable device to the axially most proximal expandable device are envisioned within the scope of the invention.

While particular embodiments of the invention have been shown and described, numerous variations and other embodiments will occur to those skilled in the art. Accordingly, it is intended that the invention only be limited in terms of the appended claims and their legal equivalents.

What is claimed is:

1. A drilling system in a drill string for enlarging a borehole in a subterranean formation, comprising:

a drill bit located at an end of the drill string;

a first expandable reamer located above the drill bit in the drill string, the first expandable reamer comprising a tubular body having a longitudinal axis and a drilling fluid flow path therethrough, a plurality of generally radially and longitudinally extending blades carried by the tubular body, a first triggering device carried by the tubular body for receiving a first actuation device introduced into the tubular body of the first expandable reamer through the drilling fluid flow path and initially retaining the blades of the plurality in a retracted or initial position, and a cutting structure carried by at least one blade of the plurality of blades, wherein at least one blade of the plurality of blades is movable outwardly, with respect to the longitudinal axis upon application of fluid pressure after the first triggering device is triggered by the first actuation device;

a second expandable reamer located above the first expandable reamer in the drill string, the second expandable reamer comprising a tubular body having a longitudinal axis and a drilling fluid flow path therethrough, a plurality of generally radially and longitudinally extending blades carried by the tubular body, a second triggering device carried by the tubular body for receiving a second actuation device introduced into the tubular body of the second expandable reamer through the drilling fluid flow path and initially retaining the blades of the plurality in a retracted or initial position, and a cutting structure carried by at least one blade of the plurality of blades, wherein at least one blade of the plurality of blades is movable outwardly, with respect to the longitudinal axis upon application of fluid pressure after the second triggering device is triggered by the second actuation device;

an expandable stabilizer axially spaced from the second expandable reamer in the drill string, the expandable stabilizer comprising a tubular body having a longitudinal axis and a drilling fluid flow path therethrough, a plurality of generally radially and longitudinally extending bearing pads carried by the tubular body, and a third triggering device carried by the tubular body for receiving a third actuation device introduced into the tubular body of the expandable stabilizer through the drilling fluid flow path and initially retaining the bearing pads of the plurality in a retracted or initial position, wherein at least one bearing pad of the plurality of bearing pads includes an up-hole cutting structure carried thereupon and is movable outwardly with respect to the longitudinal axis upon application of fluid pressure after the third triggering device is triggered by the third-actuation device; and a fixed blade stabilizer located above the drill bit and below the first expandable reamer;

wherein the second triggering device of the second expandable reamer is non-responsive to passage of the first actuation device for the first expandable reamer therethrough and wherein the third triggering device of the expandable stabilizer is non-responsive to passage of the first actuation device and the second actuation device therethrough.

2. The drilling system in a drill string for enlarging a borehole in a subterranean formation of claim 1, wherein the fixed blade stabilizer comprises at least one cutting structure, and wherein the fixed blade stabilizer is sized and configured to form a borehole having a diameter less than a diameter of a borehole formed by the first expandable reamer when the plurality of blades are in a fully extended position.

3. The drilling system in a drill string for enlarging a borehole in a subterranean formation of claim 1, wherein the expandable stabilizer is non-responsive to the first triggering device for the first expandable reamer.

4. The drilling system in a drill string for enlarging a borehole in a subterranean formation of claim 1, wherein the first triggering device is sized and configured to retain the first actuation device flowing through the drilling fluid flow path of the tubular body of the first expandable reamer, wherein the second triggering device is sized and configured to retain the second actuation device flowing through the drilling fluid flow path of the tubular body of the second expandable reamer and to enable the first actuation device to pass therethrough, and wherein the first expandable reamer and the expandable stabilizer are sequentially actuated.

5. The drilling system in a drill string for enlarging a borehole in a subterranean formation of claim 1, wherein the first expandable reamer, the second expandable reamer, and the expandable stabilizer are sequentially actuated.

6. A drilling system in a drill string for enlarging a borehole in a subterranean formation, comprising:

a first expandable reamer located above a drill bit in the drill string, the first expandable reamer comprising a tubular body having a longitudinal axis and a drilling fluid flow path therethrough, at least one generally radially and longitudinally extending blade carried by the tubular body, a first triggering device carried by the tubular body for receiving a first actuation device introduced into the tubular body of the first expandable reamer through the drilling fluid flow path and initially retaining the at least one blade in a retracted or initial position, and a cutting structure carried by the at least one blade, the at least one blade being movable outwardly, with respect to the longitudinal axis upon application of fluid pressure after the first triggering device is triggered by a first actuation device;

a second expandable reamer located above the first expandable reamer in the drill string, the second expandable reamer comprising a tubular body having a longitudinal axis and a drilling fluid flow path therethrough, at least one generally radially and longitudinally extending blade carried by the tubular body, a second triggering device carried by the tubular body for receiving a second actuation device introduced into the tubular body of the second expandable reamer through the drilling fluid flow path and initially retaining the at least one blade in a retracted or initial position, and a cutting structure carried by the at least one blade, the at least one blade being movable outwardly, with respect to the longitudinal axis upon application of fluid pressure after the second triggering device is triggered by the second actuation device; and an expandable stabilizer axially spaced from the second expandable reamer in the drill string, the expandable stabilizer comprising a tubular body having a longitudinal axis and a drilling fluid flow path therethrough, at least one generally radially and longitudinally extending bearing pad carried by the tubular body, and a third triggering device carried by the tubular body for receiving a third actuation device introduced into the tubular body of the expandable stabilizer through the drilling fluid flow path and initially retaining the at least one bearing pad in a retracted or initial position, the at least one bearing pad including an up-hole cutting structure positioned on an up-hole portion of the at least one bearing pad and a bearing surface extending from the up-hole cutting structure to a down-hole end of the at least one bearing pad, the at least one bearing pad being movable outwardly with respect to the longitudinal axis upon application of fluid pressure after the third triggering device is triggered by the third actuation device;

wherein the second triggering device of the second expandable reamer is non-responsive to passage of the first actuation device for the first expandable reamer therethrough and wherein the third triggering device of the expandable stabilizer is non-responsive to passage of the first actuation device and the second actuation device therethrough.

7. The drilling system in a drill string for enlarging a borehole in a subterranean formation of claim 6, further comprising:

a fixed blade stabilizer located below the first expandable reamer.

8. The drilling system in a drill string for enlarging a borehole in a subterranean formation of claim 7, wherein:

the drill bit is located below the fixed blade stabilizer.

9. The drilling system in a drill string for enlarging a borehole in a subterranean formation of claim 7, wherein the fixed blade stabilizer has at least one cutting structure disposed thereon, and wherein the fixed blade stabilizer is sized and configured to form a borehole having a diameter less than a diameter of a borehole formed by the first expandable reamer when the plurality of blades are in a fully extended position.

10. The drilling system in a drill string for enlarging a borehole in a subterranean formation of claim 6, wherein the expandable stabilizer is non-responsive to the first triggering device for the first expandable reamer.

11. The drilling system in a drill string for enlarging a borehole in a subterranean formation of claim 6, wherein the first expandable reamer and the expandable stabilizer are sequentially actuated.

12. The drilling system in a drill string for enlarging a borehole in a subterranean formation of claim 6, wherein the first expandable reamer, the second expandable reamer, and the expandable stabilizer are sequentially actuated.

13. A drilling system for enlarging a borehole in a subterranean formation, comprising:

a first expandable reamer comprising a tubular body having a longitudinal axis and a drilling fluid flow path therethrough, a plurality of generally radially and longitudinally extending blades carried by the tubular body, a first triggering device disposed in the tubular body for receiving a first actuation device introduced into the tubular body of the first expandable reamer through the drilling fluid flow path and initially retaining the blades of the plurality in a retracted or initial position, and a cutting structure carried by at least one blade of the plurality of blades, wherein at least one blade of the plurality of blades is movable outwardly, with respect to the longitudinal axis upon application of fluid pressure after the first triggering device is triggered by the first actuation device;

a second expandable reamer comprising a tubular body having a longitudinal axis and a drilling fluid flow path therethrough, a plurality of generally radially and longitudinally extending blades carried by the tubular body, a second triggering device disposed in the tubular body for receiving a second actuation device introduced into the tubular body of the second expandable reamer through the drilling fluid flow path and initially retaining the blades of the plurality in a retracted or initial position, and a cutting structure carried by at least one blade of the plurality of blades, wherein at least one blade of the plurality of blades is movable outwardly, with respect to the longitudinal axis upon application of fluid pressure after the second triggering device is triggered by the second actuation device; and an expandable stabilizer axially spaced from the second expandable reamer in the drill string, the expandable stabilizer comprising a tubular body having a longitudinal axis and a drilling fluid flow path therethrough, at least one generally radially and longitudinally extending bearing pad carried by the tubular body, and a third triggering device carried by the tubular body for receiving a third actuation device introduced into the tubular body of the expandable stabilizer through the drilling fluid flow path and initially retaining the at least one bearing pad in a retracted or initial position, the at least one bearing pad including an up-hole cutting structure carried thereupon and being movable outwardly with respect to the longitudinal axis upon application of fluid pressure after the third triggering device is triggered by the third actuation device;

wherein the second triggering device of the second expandable reamer is non-responsive to passage of the first actuation device for the first expandable reamer therethrough and wherein the third triggering device of the expandable stabilizer is non-responsive to passage of the first actuation device and the second actuation device therethrough.

14. A method for actuating a drilling system in a subterranean borehole, comprising:

positioning in a borehole, with a drill string, a first expandable reamer carrying a first triggering device, a second expandable reamer carrying a second triggering device, and an expandable stabilizer carrying a third triggering device, wherein the second expandable reamer is longitudinally spaced from the first expandable reamer and the expandable stabilizer is longitudinally spaced from the first expandable reamer and the second expandable reamer; and sequentially triggering the first triggering device, the second triggering device, and the third triggering device, the sequentially triggering comprising:

introducing a first actuation device into fluid flow passing through the drill string, flowing the first actuation device through a portion of the drill string, and trapping the first actuation device in the first triggering device;

after introducing the first actuation device, introducing a second actuation device into fluid flow passing through the drill string, flowing the second actuation device through a portion of the drill string, and trapping the second actuation device in the second triggering device; and after introducing the second actuation device, introducing a third actuation device into fluid flow passing through the drill string, flowing the third actuation device through a portion of the drill string, and trapping the third actuation device in the third triggering device.

15. A method for actuating a drilling system in a drill string in a borehole, comprising:

positioning in a borehole in the drill string a first tubular body element carrying at least one generally laterally movable blade and a first trigger device;

positioning in the borehole in the drill string a second tubular body element carrying at least one generally laterally movable blade and a second trigger device, the second tubular body element longitudinally spaced from the first tubular body element;

positioning in the borehole in the drill string a third tubular body element carrying at least one generally laterally movable bearing pad and a third trigger device, the third tubular body element longitudinally spaced from the first tubular body element and the second tubular body element;

introducing a first actuating device into the drill string, flowing the first actuating device through an another tubular body element and trapping the first actuating device in the first trigger device; and subsequent to introducing the first actuating device, introducing a second actuating device into the drill string, flowing the second actuating device through the drill string, and trapping the second actuating device in the second trigger device.

16. The method of claim 15, further comprising introducing a third actuating device into the drill string, flowing the third actuating device through the drill string, and trapping the third actuating device in the third trigger device.

17. The method of claim 15, further comprising:

attaching a drill bit on the drill string.

18. The method of claim 17, wherein the first tubular body element comprises a first expandable reamer positioned in the drill string above the drill bit.

19. The method of claim 18, wherein the second tubular body element comprises an expandable stabilizer positioned in the drill string above the first expandable reamer.

20. The method of claim 18, wherein the second tubular body element comprises a second expandable reamer positioned in the drill string above the first expandable reamer.

21. The method of claim 15, wherein the third tubular body element comprises an expandable stabilizer positioned in the drill string.

22. The method of claim 17, further comprising:

positioning a fixed blade stabilizer in the drill string above the drill bit.

23. The method of claim 15, wherein the first tubular body element comprises a first expandable reamer positioned in the drill string above a drill bit.

24. The method of claim 23, wherein the second tubular body element comprises an expandable stabilizer positioned in the drill string above the first expandable reamer.

25. The method of claim 23, wherein the second tubular body element comprises a second expandable reamer positioned in the drill string above the first expandable reamer.

26. The method of claim 23, wherein the third tubular body element comprises an expandable stabilizer positioned in the drill string.

* * * * *

UNITED STATES PATENT AND TRADEMARK OFFICE

CERTIFICATE OF CORRECTION

PATENT NO. : 8,205,689 B2
APPLICATION NO. : 12/433939
DATED : June 26, 2012
INVENTOR(S) : Steven R. Radford It is certified that error appears in the above-identified patent and that said Letters Patent is hereby corrected as shown below:

In the specification:

| | | |
|---|---|---|
| COLUMN 6, | LINE 64, | change "in U.S." to --in above-referenced U.S.-- |
| COLUMN 11, | LINE 22, | change "strimming." to --trimming.-- |

Signed and Sealed this
Twentieth Day of October, 2015

Michelle K. Lee

Michelle K. Lee
*Director of the United States Patent and Trademark Office*